US007946543B2

(12) United States Patent
Cotter et al.

(10) Patent No.: US 7,946,543 B2
(45) Date of Patent: May 24, 2011

(54) CLOSET CARROUSEL

(75) Inventors: Donna M. Cotter, San Rafael, CA (US); Laurie L. Anderson, Corte Madera, CA (US)

(73) Assignee: Donna M Cotter, San Rafael, CA (US)

( * ) Notice: Subject to any disclaimer, the term of this patent is extended or adjusted under 35 U.S.C. 154(b) by 0 days.

(21) Appl. No.: 12/152,110

(22) Filed: May 9, 2008

(65) Prior Publication Data

US 2009/0278010 A1 Nov. 12, 2009

(51) Int. Cl.
*F16M 13/00* (2006.01)

(52) U.S. Cl. ..... 248/159; 248/251; 248/415; 248/326; 211/1.53; 312/135

(58) Field of Classification Search ..... 312/135; 248/159, 251, 415, 422, 317, 323, 326; 211/1.51, 211/1.52, 1.53, 1.54, 1.55, 85.3, 34, 36, 144, 211/163, 90.01, 95, 100, 104, 105.3
See application file for complete search history.

(56) References Cited

U.S. PATENT DOCUMENTS

| | | | | | |
|---|---|---|---|---|---|
| 3,563,390 | A * | 2/1971 | Kim | 211/35 |
| 4,084,867 | A * | 4/1978 | Putt et al. | 312/198 |
| 4,125,300 | A * | 11/1978 | Putt et al. | 312/351 |
| 4,838,625 | A * | 6/1989 | Taylor | 312/249.5 |
| 4,946,048 | A * | 8/1990 | Francois | 211/34 |
| 5,118,176 | A * | 6/1992 | Motley, Sr. | 312/305 |
| 6,086,171 | A * | 7/2000 | Ashley et al. | 312/97.1 |
| 7,229,057 | B2 * | 6/2007 | Cavell | 248/343 |
| D551,473 | S * | 9/2007 | Greiner | D6/514 |
| D566,986 | S * | 4/2008 | Greiner | D6/411 |

* cited by examiner

*Primary Examiner* — Korie Chan

(57) ABSTRACT

Closet carrousel having a motorized vertical support tube that attaches to the floor and ceiling of a standard closet. horizontal support tube arms radiate from the vertical support tube. Three arms extend out from the out from the upper region of the vertical tube and three arms extend out from the lower region of the support tube. The support tubes are slidably mounted on inner support rods. Each support rod is made of a first rod and a second rod that are hinged together to form one long rod. The support tubes hold standard hangers for hanging garments. The user can slide a horizontal support tube out past the hinged portion of the inner support rod so that the inner rod may be bent by the user thereby exposing and giving access to an inner core of shelving members.

4 Claims, 11 Drawing Sheets

CLOSET CARROUSEL

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of closet accessories and more specifically to a closet carrousel.

The need for maximizing closet space in the home, hotel or office has been increasing as the price of square footage of residential and office space has increased.

The conventional use of a clothes standard closet is to have one horizontal rod for hanging garments and one upper shelf above the hanging rod for storing other items. Clothes hung on the hanger rod tend to be smashed together and are hard to view. The top shelf is hard to reach and holds limited items.

In an effort to maximize the use of space in a closet W. V. Pittman in his U.S. Pat. No. 2,326,064 proposed a rotary wardrobe where a central vertical pole holds and annular ring which can support hangers and garments. The lower portion of the wardrobe contains shelving for shoes. One horizontal pole can extend outward and can hold items of clothing such as a men's suit.

However, there is a deficiency in the prior technology in that the average closet is only twenty-four inches deep, making the full utilization of the circular hanging bar an impossibility since the average hanger is approximately fourteen inches wide. Two hanging items side by side would take up a space that is wider than the average width of a closet. Additionally, no use is made of the space at the core of the wardrobe where garments are being held, thereby making it less desirable as a space saver. Additionally, the use of a slide out pole as well as the hanging ring makes it difficult to have access to the garments hung on the hanging ring, even though there is a provision made to slide the hanging pole outward. Lastly, since there is no provision for a motor to turn the central pole, it is difficult for the user to rotate the wardrobe to find the desired garment.

BRIEF SUMMARY OF THE INVENTION

The primary object of the invention is to provide a way to store clothes and other items in a closet so that the user makes maximum use of the closet space and can have easy access to all items stored.

Another object of the invention is to provide a way to hang clothes on revolving hanger rods.

Another object of the invention is to provide a way to pull out the hanger rods to reveal shelving at the center of the revolving clothes hanging and storage system.

A further object of the invention is to provide a revolving clothes hanging and storage system that is motorized and can revolve by use of a remote control actuator.

Yet another object of the invention is to provide a revolving clothes hanging and storage system that includes an optional lighting device.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed Closet carrousel comprising: a vertical support tube tube, a vertical support tube height adjustment tube, a gear reduced motor enclosed in a housing having a flanged base plate, a gear shaft to vertical support tube coupling member, a top tube retaining member, six inner horizontal rods, six rod hinge members, six horizontal support tubes capable of supporting a plurality of standard garment hangers, a pair of horizontal rod retaining plates each having a central aperture and each having, a plurality of shelf members each having an equilateral triangular shape when seen in plan view, six horizontal tube retaining tethers, a 110 VAC power cord and plug, and a standard remote control on-off switch, said shelf members including a centrally located tube mounted to the floor of each shelf capable of sliding onto said vertical pole member, said shelf members capable of stacking on top of each, said height adjustment tube sliding into said vertical tube by a user and locked in place by a locking screw, the lower end of said vertical support tube fixed to said gear shaft pole coupling member, said shaft pole coupling member fixedly attached to said motor shaft, said flanged base plate flange including a plurality of apertures for securing said flange to a closet floor with screws, the upper end of said vertical support tube engaging said top tube retaining member, said top tube retaining member having a flange with a plurality of apertures for securing said flange to the ceiling of said closet by means of screws, each said inner horizontal rod comprised of a first rod, a second rod, said hinge member holding said rods together longitudinally forming one hinged rod, said first rod member each fixedly attached at one end to the perimeter of said horizontal rod retaining plate, said rod members attached to said rod retaining plates so that said three said rod members extend radially outward from said rod retaining plate at one hundred and twenty degrees from each other, one said retaining plate and rod assembly fixedly attached via said central aperture to the upper region of said vertical support tube and the second said retaining plate and rod assembly attached to the lower region of said vertical support tube, said horizontal support tubes slid over said horizontal support rods, said horizontal support tube capable of sliding out beyond said rod hinge so that said second rod portion and said horizontal support tube can be bent at an angle via said rod hinge, each said horizontal support tube restrained from sliding further than just beyond said rod hinge by said horizontal tube retaining tethers, said upper three horizontal support tubes capable of holding an upper tier of garments and said lower three horizontal support tubes capable of holding a lower tier of garments and said shelf members being triangular in plan view and when stacked upon each other are capable of filling the empty space left at the core of said carrousel not taken up by said standard hangers and hung garments.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
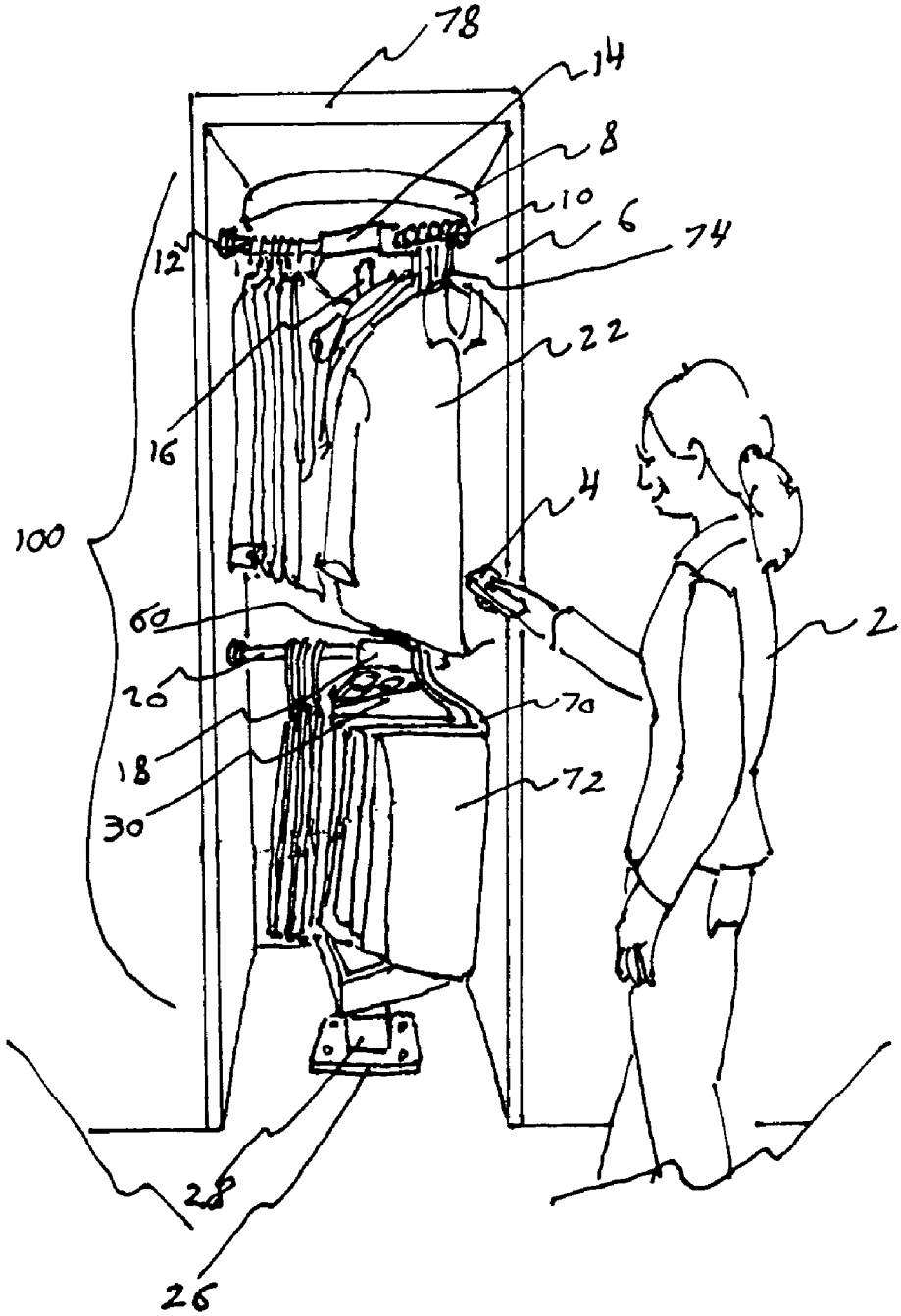
FIG. 1 is a perspective view of the invention.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Referring now to Figure one we see a perspective view of the invention 100 seen within a standard closet 6 as defined by closet frame 78. A user 2 is holding a standard remote actuator 4 that can turn on and off a motor located in base housing 28. The gear reduced motor is coupled to central vertical tube 16 and can cause the tube 16 to revolve thereby causing the attached horizontal tubes 10, 12, 20, 60 and associated garments 22, garment hangers 74, pants 72, and pants hangers 70 to also revolve thereby giving the user easy access to all the garments held by the invention 100. The horizontal support tubes are held by holding plates 14, 18. The holding plates are located so that one set of garments can be hung on the upper set of horizontal rods and one set of garments can be hung on the lower set of horizontal rods. Shelves 30 are located at the core of the closet carrousel storage system 100 and are stacked one on top of the other as will be explained below. Top most shelf 8 is round and can store items such as hats. In the preferred embodiment, the shelf 8 is made of transparent plastic so that the user can easily see what is stored on the shelf 8.

Figure 2:
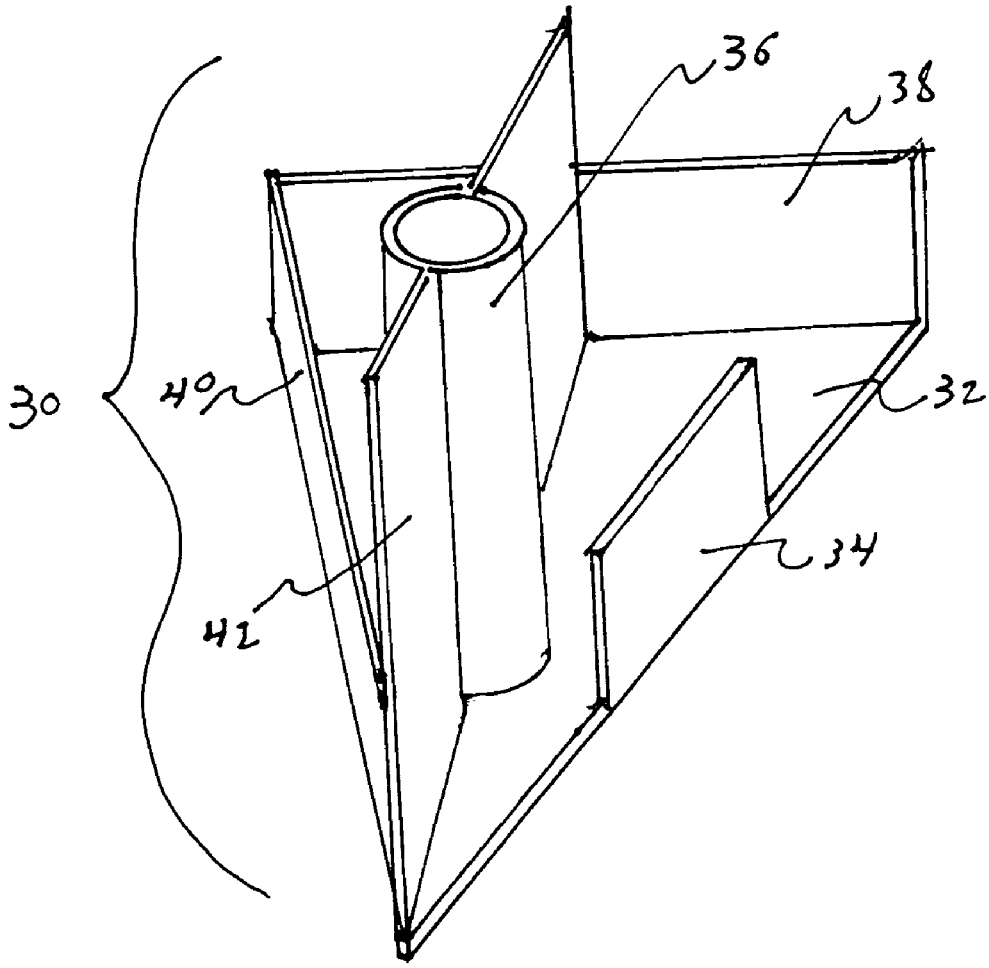
FIG. 2 is a perspective view of a shelf of the invention.

Referring now to FIG. 2 we see a shelf member 30. The shelf is triangular in plan view and includes a central tube that can slide over the main vertical support tube. A central partition 42 bisects the shelf space and side walls 38, 40 help hold items such as socks, undergarments, and the like from falling out. Partial wall 34 helps to hold shoes in place on the floor 32 of the shelf member. Shoes that are extra large are allowed to protrude beyond the shelf perimeter through the spaces left on either side of wall 34. The height of each shelf member is approximately six inches. Ten identical shelves can stack on top of each other to maximize the amount of storage space found at the core of the present invention 100.

Figure 3:
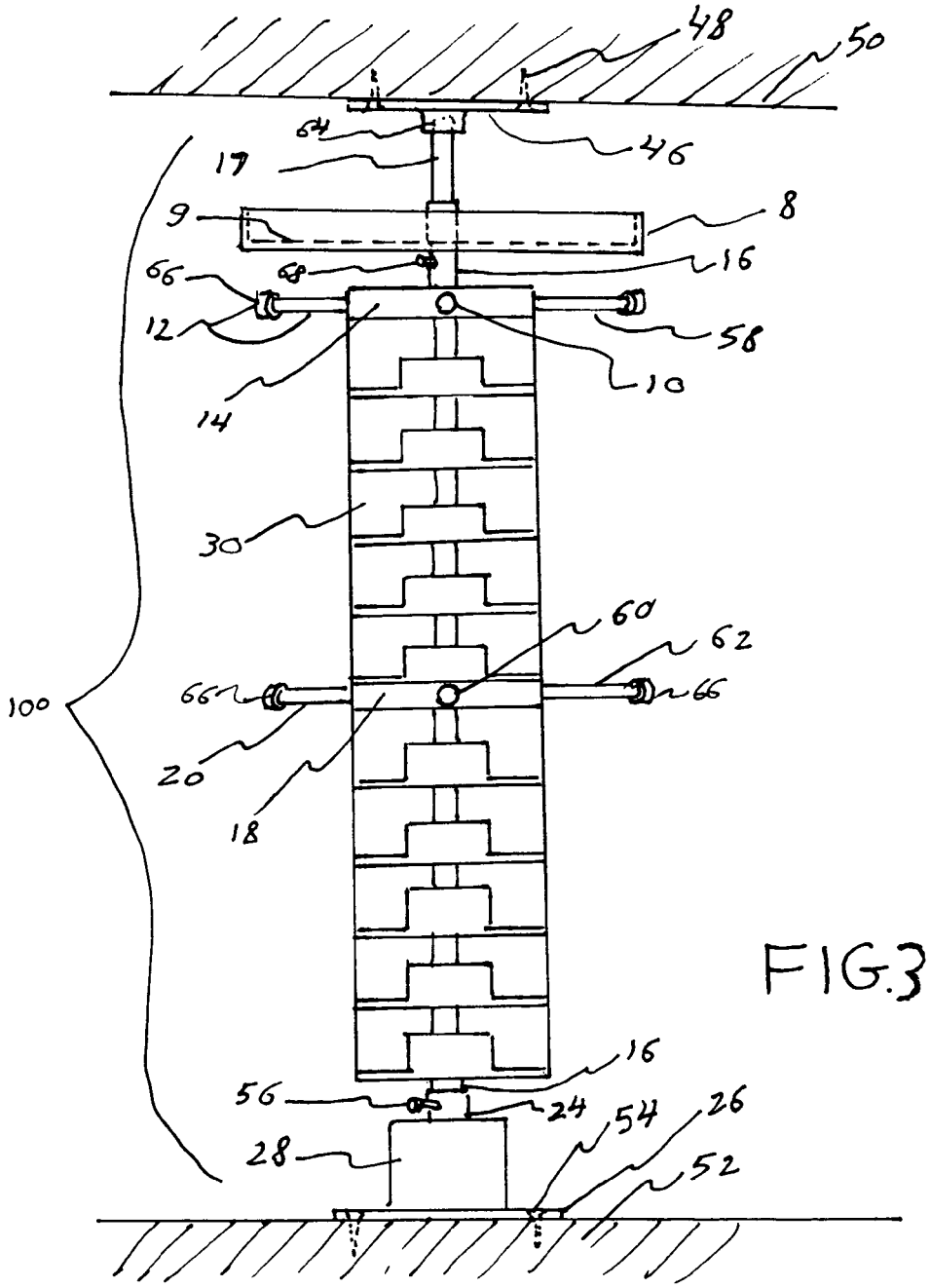
FIG. 3 is a front view of the invention.

FIG. 3 shows a front view of the invention 100. The motor housing 28 can be seen. It houses a standard gear reduced motor that operates at one hundred and ten volts AC. A coupling member 24 helps secure the vertical tube 16 to the motor shaft, not shown. Locking screw 56 locks the two together. Base plate 26 includes a flange that has a plurality of apertures for securing screws 54 into the floor portion 52 of the closet. Top tube retaining member 64 includes a flange 46 with apertures to secure screws 48 to the ceiling 50 of the closet. An adjustment tube 17 slides into main vertical support tube 16 so that the entire vertical assembly 100 can be adjusted to fit closets with varying ceiling heights. Locking screw 68 locks the height adjustment tube 17 to the main vertical tube 16. Upper shelf 8 can be clearly seen. Dotted line 9 shows the inner construction of the shelf 8. Horizontal tubes 10, 14, 58, are held by horizontal plate 14 and form the upper hanging surfaces Tubes 20, 60, 62 are held by horizontal plate 18 and form the lower hanging surfaces. End caps 66 prevent hangers from falling off the horizontal tubes. Ten shelves 30 are identical to each other and are stacked one on top of the other to form a column of storage space that completely takes up the empty space left between the six groups of hanging garments.

Figure 4:
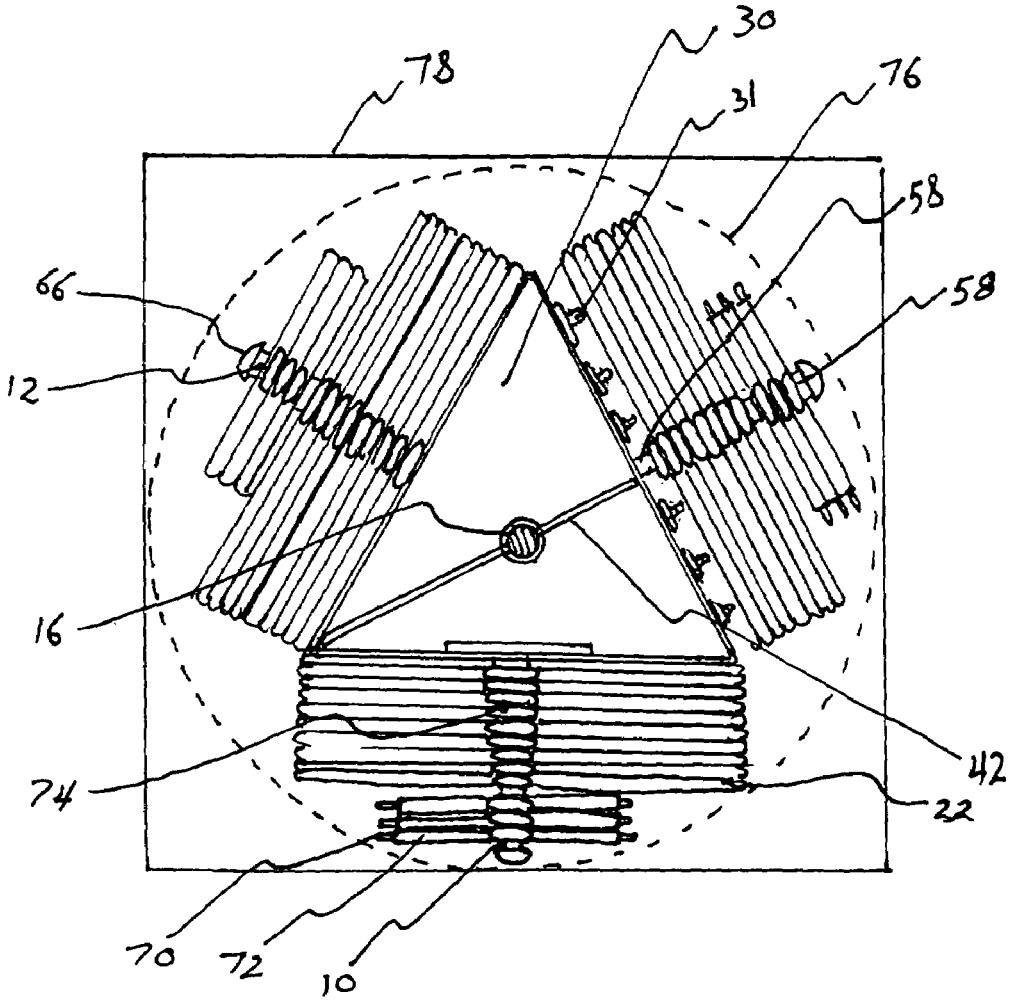
FIG. 4 is a top view of the invention.

FIG. 4 shows a top plan view of the invention with hangers in place. Garments 22 hanging on standard garment hangers 74 hang on horizontal tubes 10, 12, 58. Triangular shelf 30 occupies all the space between the hangers on the three support tubes 10, 12, 58. Dotted line 76 indicates the rotational path taken by the support tubes 10, 12, 58 as they revolve about the central vertical support tube 16. Standard hooks 31 are mounted on one side of shelf 30 and can be used to hang, ties, belts, jewelry and the like. Pants hangers 70 are narrower than standard hangers 74 and can be placed at the outer most portion of horizontal tubes 10, 12, 58 for maximum use of space. End caps 66 keep hangers from falling off. The external closet frame is represented by square perimeter line 78.

Figure 5:
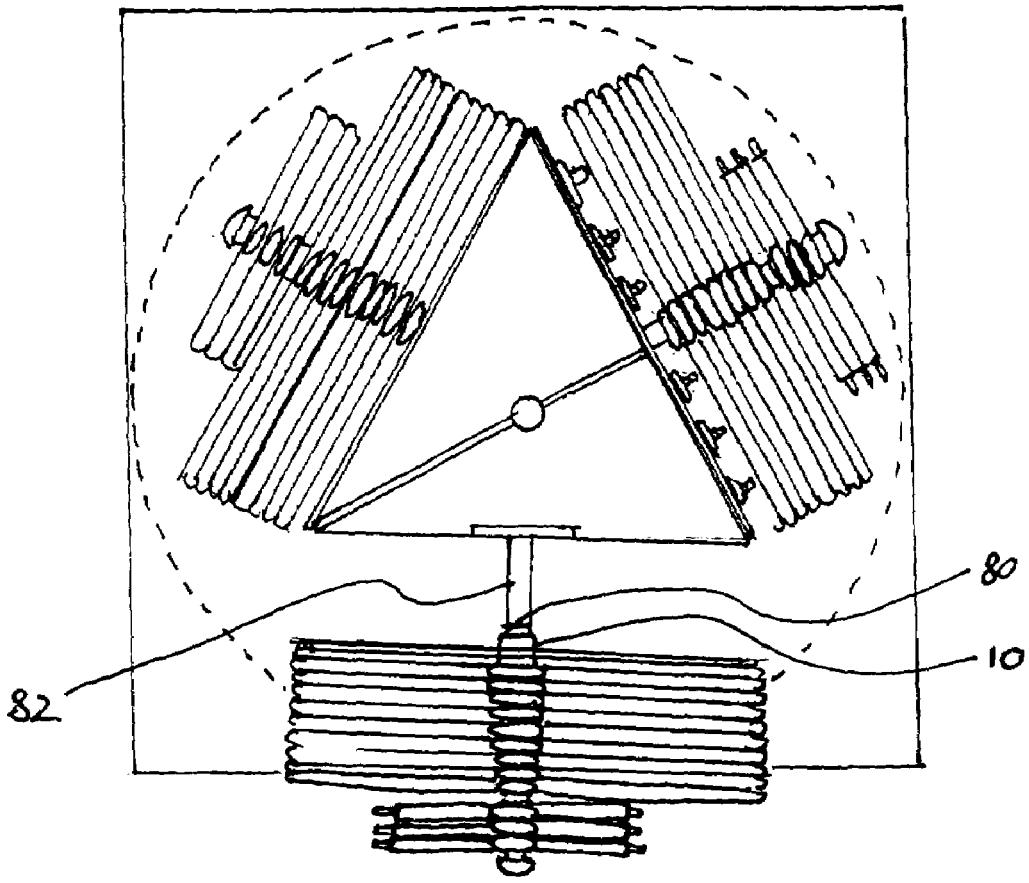
FIG. 5 is a top view of the invention with one horizontal tube pulled out.

FIG. 5 shows tube 10 pulled out on rod 82. The tube 10 is pulled just beyond hinge member 80.

Figure 6:
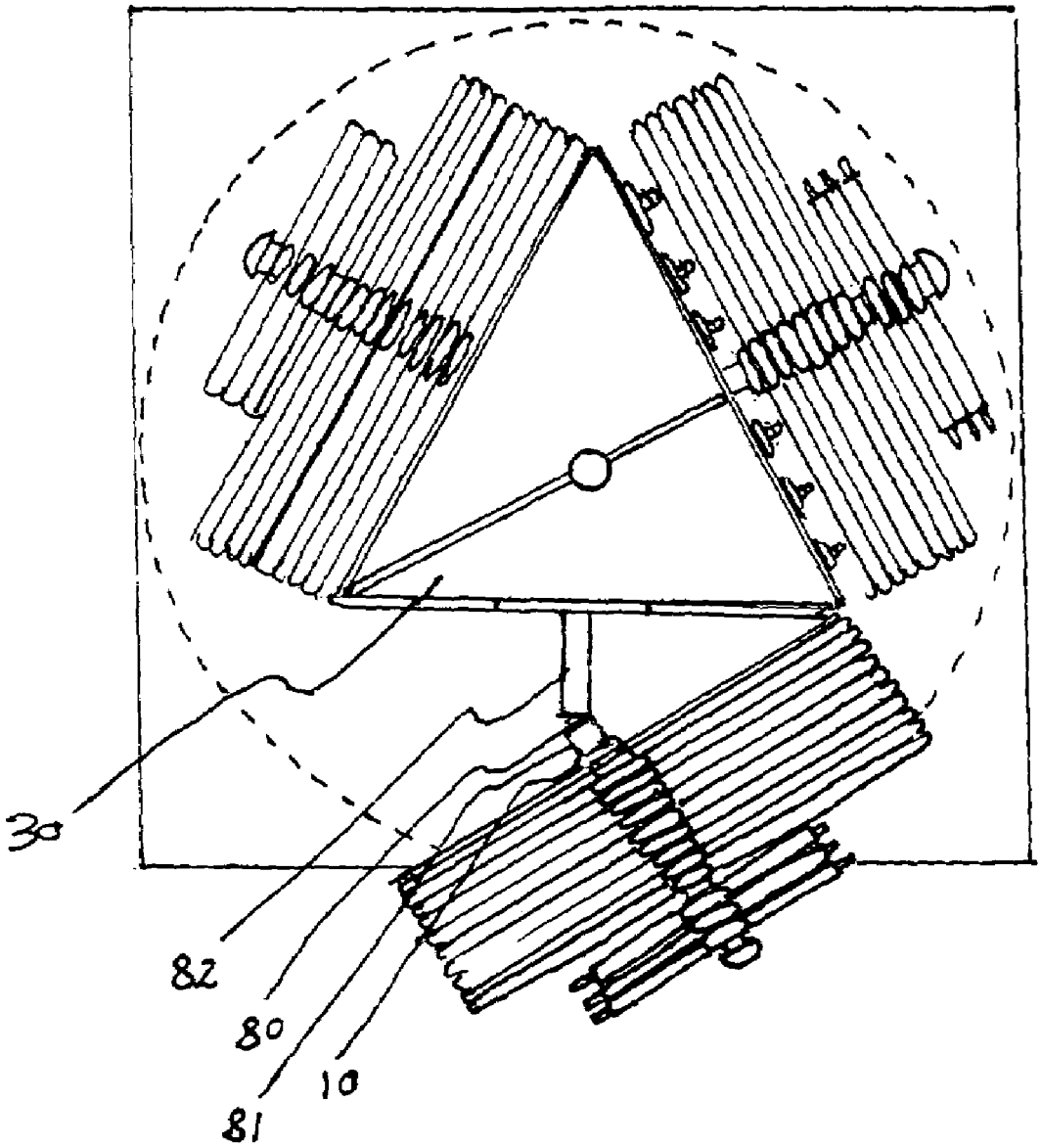
FIG. 6 is a top view of the invention with one horizontal tube pulled out and bent at an angle.

FIG. 6 shows tube 10 bent at an angle thereby exposing the contents of shelf members 30

Figure 7:
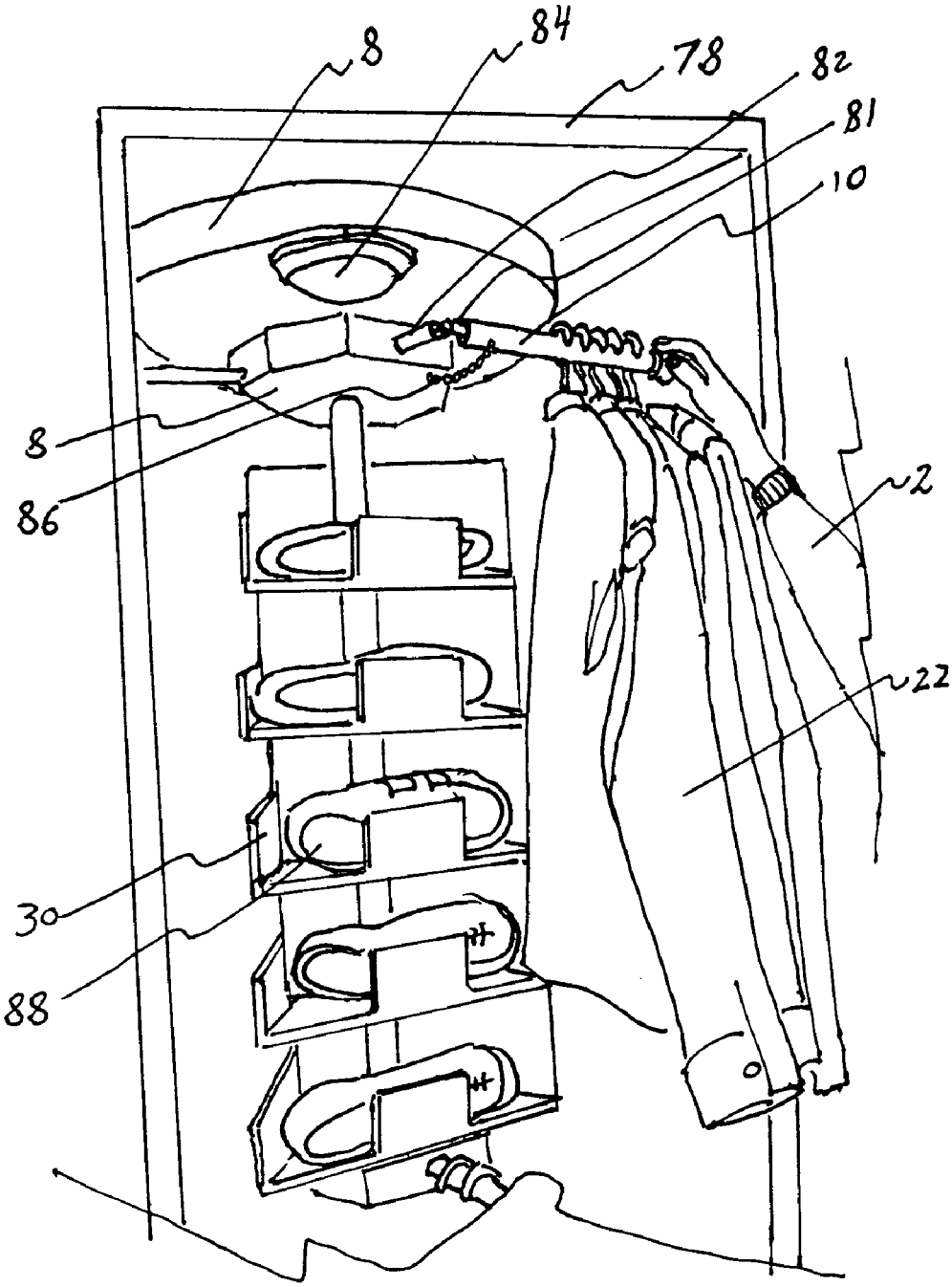
FIG. 7 is a partial perspective view of the upper portion of the invention.

FIG. 7 is a partial perspective view of the invention showing a user 2 pulling on tube 10 and attached garments 22 to expose the contents of shelf members 30. Shoes 88 are shown stored on the shelf members 30. An optional battery powered light fixture 84 is shown attached to the underside of upper shelf 8.

Figure 8:
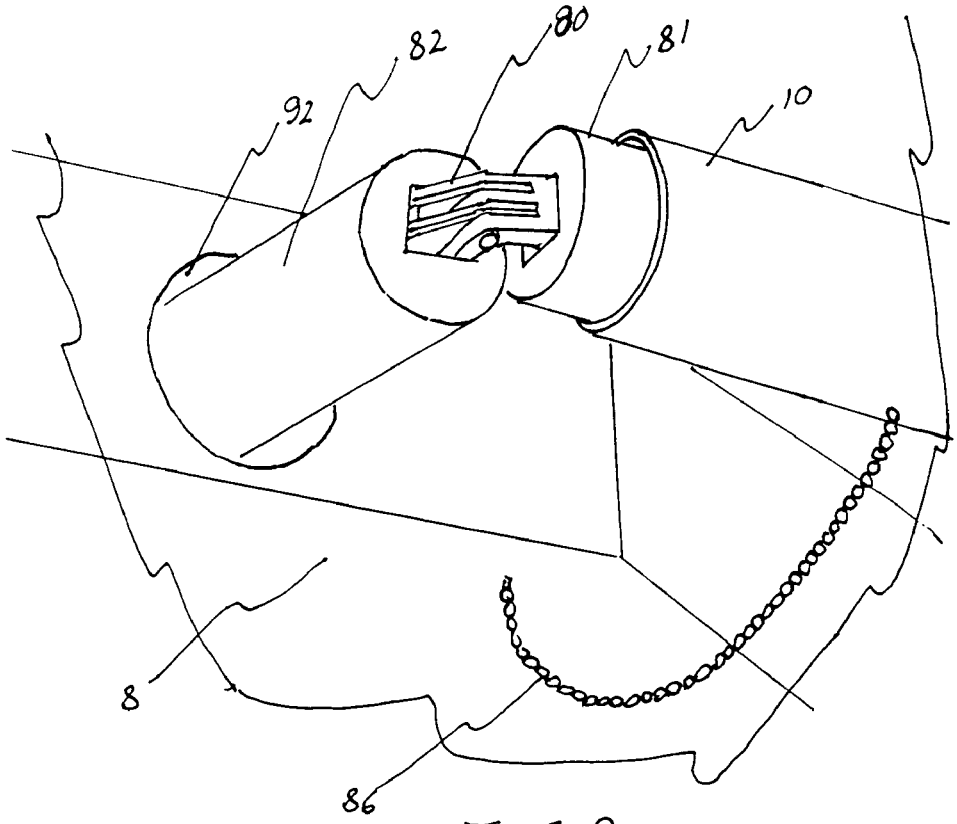
FIG. 8 is a partial perspective view of the rod hinge portion.

FIG. 8 shows a detail of hinge member 80 that holds rod members 81, 82 together. The hinge is an invisible mortise-mount type hinge that can completely disappear when the rod members 81, 82 are longitudinally aligned. Retaining tether 86 is clearly seen as attached to the underside of horizontal tube holding plate 8 on one side and to the underside of tube 10 on the opposite side. Enlarged aperture 92 allows sliding horizontal support tube 10 to enter the holding plate 8 as will be explained below.

Figure 9:
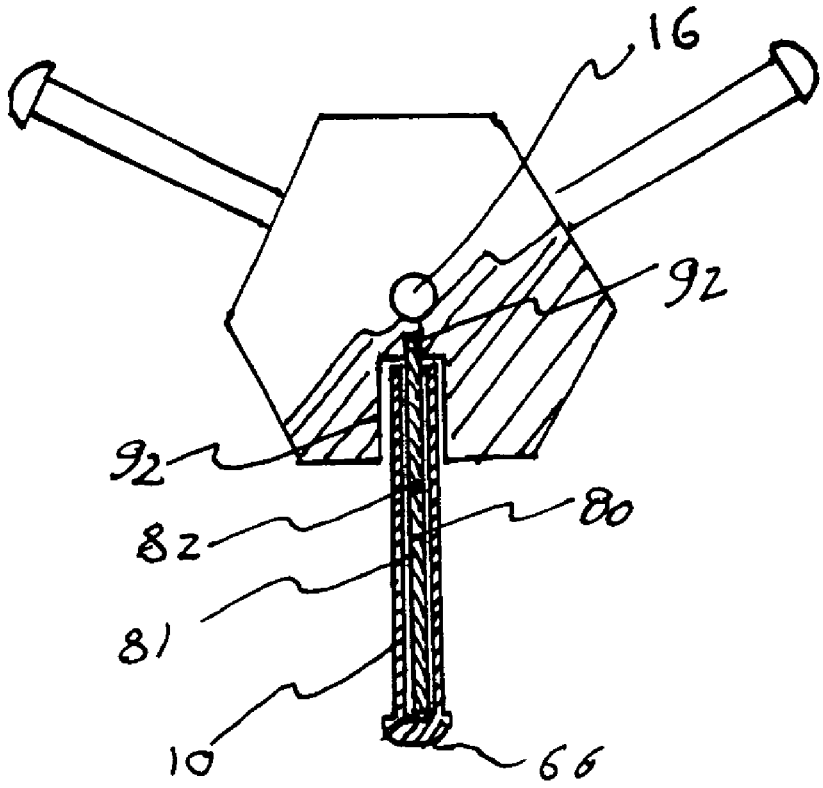
FIG. 9 is a partial section view of a horizontal rod in the pushed in position.
Figure 10:
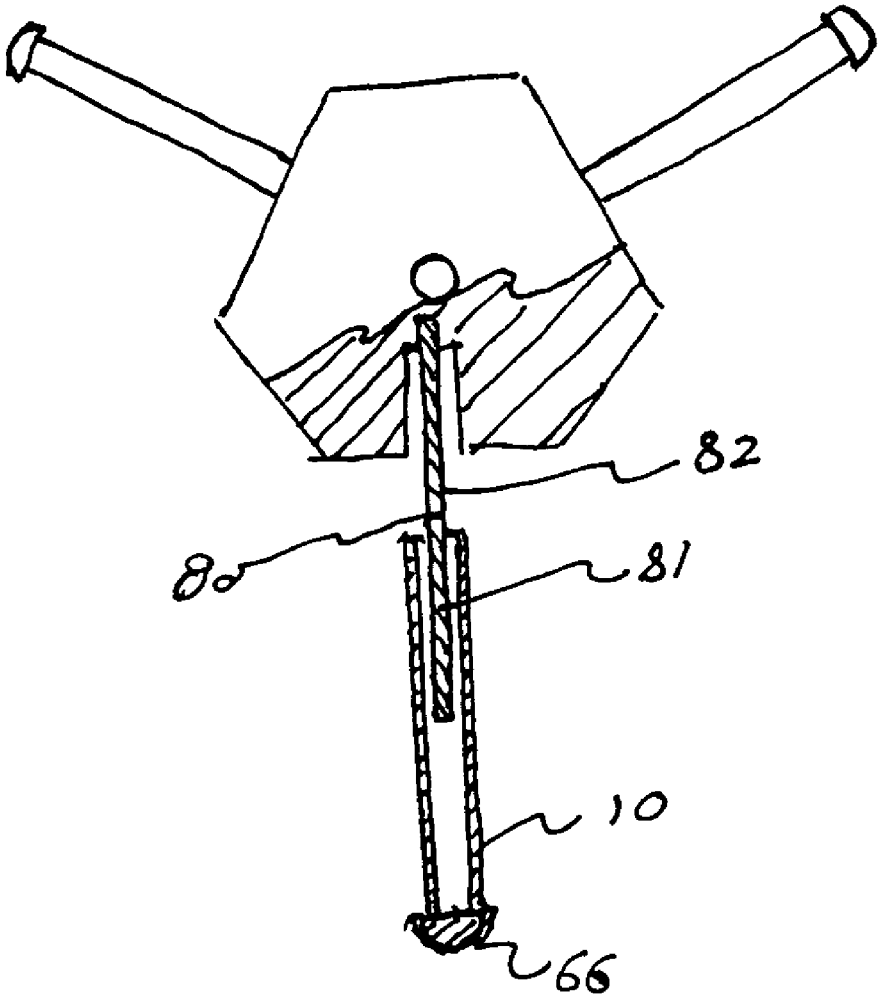
FIG. 10 is a partial section view of a horizontal rod in the pulled out position.
Figure 11:
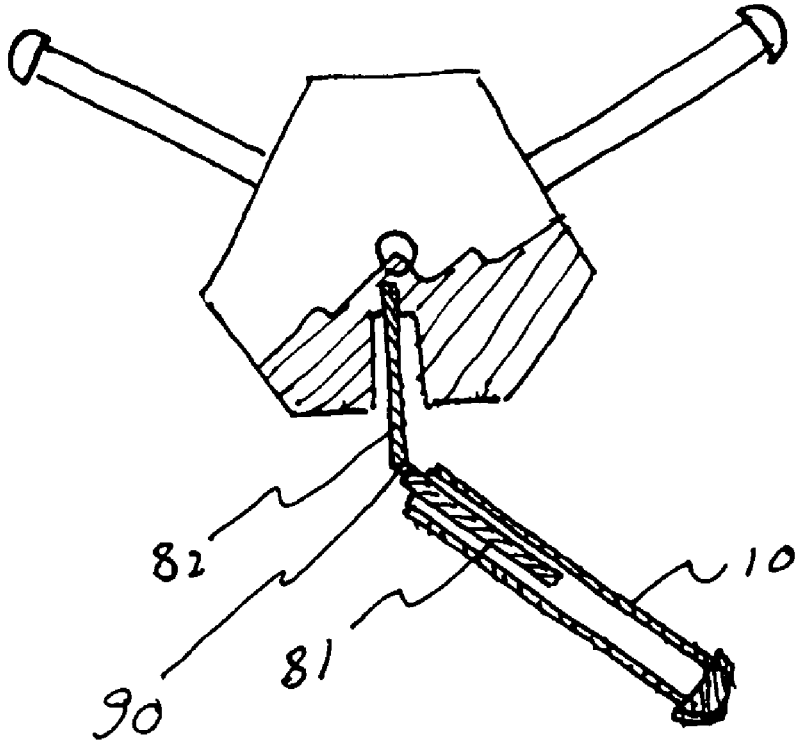
FIG. 11 is a partial section view of a horizontal rod in the pulled out and bent position.

FIG. 9 shows a partial section view of horizontal tube holding plate 8. The geometry of the system requires that horizontal tube 10 be inserted into horizontal tube 8 to stay within the twenty-four inch radius that is needed for the invention 100 to reside in a standard closet. The depth of aperture 92 is clearly shown. Rod 82 is held firmly in place at junction 92. FIGS. 10 and 11 show the pull out and bend feature that is crucial to the operation of the present invention.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Closet carrousel comprising: a vertical support tube; a height adjustment tube; a gear reduced motor enclosed in a housing having a flanged base plate having a peripheral flange; a motor shaft; a coupling member; a top tube retaining member; six inner horizontal rods; six rod hinge members; six horizontal support tubes capable of supporting a plurality of standard garment hangers; a pair of horizontal rod retaining plates each having a central aperture; a plurality of shelf members each having an equilateral triangular shape; six horizontal tube retaining tethers; a 110 VAC power cord and plug; and a remote control on-off switch; each of said shelf members including a centrally located tube mounted to a floor of each of said shelf members capable of sliding onto said vertical support tube; said shelf members capable of stacking on top of each other; said height adjustment tube sliding into said vertical support tube and locked in place by a locking screw; a lower end of said vertical support tube fixed to said coupling member; said coupling member fixedly attached to said motor shaft; said flanged base plate flange including a plurality of apertures for securing said flange to a closet floor with screws; an upper end of said vertical support tube engaging said top tube retaining member; said top tube retaining member having a flange with a plurality of apertures for securing said top tube retaining member flange to the ceiling of said closet by means of screws; each said inner horizontal rod comprised of a first rod, a second rod, each of said rod hinge members holding said first and second rods together longitudinally forming one hinged rod; said first rod each fixedly attached at one end to a perimeter of said horizontal rod retaining plate; said first rods attached to said rod retaining plates so that a respective of said three of said six inner horizontal rods extend radially outward from a respective one of said pair of said rod retaining plates at one hundred and twenty degrees from each other; one of said horizontal rod retaining plates and said inner horizontal rods attached thereto fixedly attached via said central aperture to the upper region of said vertical support tube and the second of said horizontal rod retaining plates and said inner horizontal rods attached thereto attached to the lower region of said vertical support tube; said horizontal support tubes slid over said inner horizontal support rods; each of said horizontal support tube capable of sliding out beyond said rod hinge members so that said second rod and said horizontal support tube can be bent at an angle via said rod hinge member; each said horizontal support tube restrained from sliding further than just beyond said rod hinge members by said horizontal tube retaining tethers; said upper three horizontal support tubes capable of holding an upper tier of garments and said lower three horizontal support tubes capable of holding a lower tier of garments; said shelf members being triangular and when stacked upon each other are capable of filling the empty space left at the core of said carrousel not taken up by said standard hangers and hung garments and said motorized closet carrousel being made to revolve when a user turns on said standard remote control on-off switch.

2. Closet carrousel as claimed in claim 1 further comprising an uppermost shelf and a battery operated lighting fixture fastened to the uppermost shelf and aiming down to illuminate said hung garments and said shelf members.

3. Closet carrousel as claimed in claim 1 further comprising a top most shelf that includes a centrally located aperture for fitting onto said vertical support tube and round in plan view and situated between said top tube retaining member and said stacked triangular shelf member.

4. Closet carrousel as claimed in claim 1 wherein each said horizontal tube support member is terminated on one end by a flanged end cap that prevents hangers from sliding off said horizontal tube support member.

* * * * *